United States Patent [19]

Marshall

[11] 4,295,232

[45] Oct. 20, 1981

[54] DEVICE FOR HUMAN BODY WASTE ELIMINATION DURING INCAPACITATION

[76] Inventor: Jeweral E. Marshall, Box 57, Oldtown, Md. 21555

[21] Appl. No.: 157,328

[22] Filed: Jun. 9, 1980

[51] Int. Cl.[3] ..... A47K 11/06

[52] U.S. Cl. ..... 4/480; 4/457; 4/478; 4/483

[58] Field of Search ..... 4/483, 457, 234, 480, 4/478, 254

[56] References Cited

U.S. PATENT DOCUMENTS

| | | | |
|---|---|---|---|
| 3,213,467 | 10/1965 | Hubbard | 4/478 |
| 3,619,820 | 11/1971 | Cain et al. | 4/254 |
| 3,795,923 | 3/1974 | Thomas | 4/483 |
| 3,829,908 | 8/1974 | Thomas | 4/483 |
| 3,854,773 | 12/1974 | Thomas | 4/254 X |
| 4,045,044 | 8/1977 | Bianer | 4/483 |
| 4,052,087 | 10/1977 | Gagliendi | 4/483 X |
| 4,155,126 | 5/1979 | Classen | 4/478 |
| 4,254,514 | 3/1981 | Sakamoto | 4/234 |

*Primary Examiner*—Henry K. Artis

*Attorney, Agent, or Firm*—Walter G. Finch

[57] ABSTRACT

The invention is a device to assist people who are incapacitated by age, injury, illness, or other causes, to eliminate body waste. The device may be used while in bed or while seated. The device consists of two segments. A first segment (in conjunction with the second segment) is used when the user is confined to a bed. A second segment is combined with the first segment for use when the user is able to sit up, as in a chair. The first segment consists of a pair of side supports which are fastened to the second segment and may be set at various angles in relation to the horizontal. A transverse member is affixed to the side supports, the transverse member having suitable leg rests therein to support the user's legs at various angles in a plurality of positions to assist in the human waste elimination. The second segment consists of framework having adjustable levels for a combination of a bed pan and a toilet seat in a plurality of positions for use in the special technique for human body waste elimination for which the invention was developed. The first segment is affixed to the second segment to form a backrest for the user.

4 Claims, 5 Drawing Figures

DEVICE FOR HUMAN BODY WASTE ELIMINATION DURING INCAPACITATION

BACKGROUND AND SUMMARY OF THE INVENTION

The invention relates to hospital type equipment, and in particular, equipment used for body waste elimination. Specifically, the invention relates to equipment for persons who are incapacitated due to age, injury, illness, or other causes. The invention may be used by a user confined to a bed or by a user who is able to sit in a chair.

Elimination of the human body waste products from the kidneys and the intestines is usually voluntary and efficient unless pathological conditions exist. However, that elimination for a healthy person having a healthy intestine and healthy urinary system is quite normal for one who is up and about in a daily routine, but it is another matter for that same person if he or she is bedfast and/or chair fast because of some pathological condition.

The present invention overcomes the problems which may arise because of a pathological condition. The invention is useable by male or female users. Any reference to one sex or the other herein is meant to refer to both sexes.

For bedfast and/or chair fast persons, because of age, injury, illness, or other causes, who may or may not be on a special diet where fluids and food stuffs are limited and often essential nutritional items may be omitted, along with limited activity, these factors may impair the ability to expel urine and fecal matter. This invention overcomes such problems.

Many pathological conditions further impede the ability to respond adequately to the urge to eliminate the human body waste, such as cardiac conditions, nuerological conditions, fractures in the upper torso, and many others.

Medical care personnel recognize that constipation and urinary retention often influence how patients and aged persons under nursing type care respond to their therapy. The discomforts and anxieties that are brought on by the person's inability to eliminate the body wastes increases the intensity of pain and even stimulates a pseudo type pain when actual pain may be absent.

Mere frustration is immenent when a person, faced with the aforementioned conditons, for whatever reason, cannot voice his need to eliminate the human body wastes, or voice his discomfort at the time. As a result other symptoms arise requiring treatment of a multitude of accompanying symptoms such as temperature elevation, nausea, vomiting, restlessness, attitudes, mood changes, and failure to respond to therapy. The present invention is an aid in eliminating these problems.

Often the aforementioned problems, because of the symptoms exhibited, may result in the attending physician changing the course of treatment.

After years of nursing at the bedside the present inventor as a Licensed Practical Nurse and as a Registered Nurse, observing the prescribing of stool softeners, laxatives, fruits such as prunes, enemas, and other similar means to assist the discomforted and distressed person, with no completely satisfactory results, the position of the body in relating to the need to expel body wastes was studied.

It has been evident that the actual body position used for the devices of the prior art was a cause in itself of constipation type problems and urinating type problems. As a result, a new body position was developed that assists in the elimination of the body wastes and coupled with this body position development, the present device was invented. The new body position may be described as Marshall's Squat Technique, or with the use of the present invention, may be described as Marshall's Modified Squat Technique. The two terms may be used interchangeably.

It is to be understood that the aforementioned squat technique would not be possible for an incapacitated person, particularly one who is bed fast and/or chair fast with little or no ability to move about on their own. The invention provides the means whereby the medical care personnel can place the distressed person in a position equivalent to the aforementioned squat technique while remaining in bed or in a seated position.

It is to be understood that the device for human body waste elimination of this invention may be used on hospital type beds or any other type beds.

In order to understand the invention the squat technique will be described, the purpose of which is to assist the distressed person in terms of effective body waste elimination.

The rationale of the technique is that by bringing the knees toward the chest, in varying degrees, exerts gentle pressure on abdominal contents. This action assists in the elimination of congestion in the perineal area and also eliminates pressure toward the lumen of the urethra and the anal sphincter muscle.

The invention that assists the bed fast and/or chain fast person in connection with the aforementioned problems consists of two segments of the invented structure. The first segment is used for bed fast persons who must remain in bed, and the second segment provides the means for persons who may be placed in a seated position. Both segments form the overall structure and are used together.

It is, therefore, an object of the invention to provide a device for human body waste elimination that may be used for persons who are incapacitated by reason of age, injury, illness, and other such causes.

It is also an object of the invention to provide a device for human body waste elimination which may be used by an incapacitated person who is bed fast and must remain in bed.

It is another object of the invention to provide a device for human body waste elimination which may be used by an incapacitated person who is able to be seated in a chair.

It is still another object of the invention to provide a device for human body waste elimination which is adjustable to a plurality of positions in conjunction with the ability of the user to use the device to assist in the elimination of body wastes.

It is yet another object of the invention to provide a device for human body waste elimination that is compatible for assisting incapacitated persons in using a squat type technique of body waste elimination while confined to a bed.

It is yet still another object of the invention to provide a device for human body waste elimination that is compatible for assisting incapacitated persons in using a squat type technique of body waste elimination while confined in a seated position.

Further objects and advantages of the invention will become more apparent in the light of the following description of the preferred embodiments.

DESCRIPTION OF THE PREFERRED EMBODIMENTS

Figure 1:
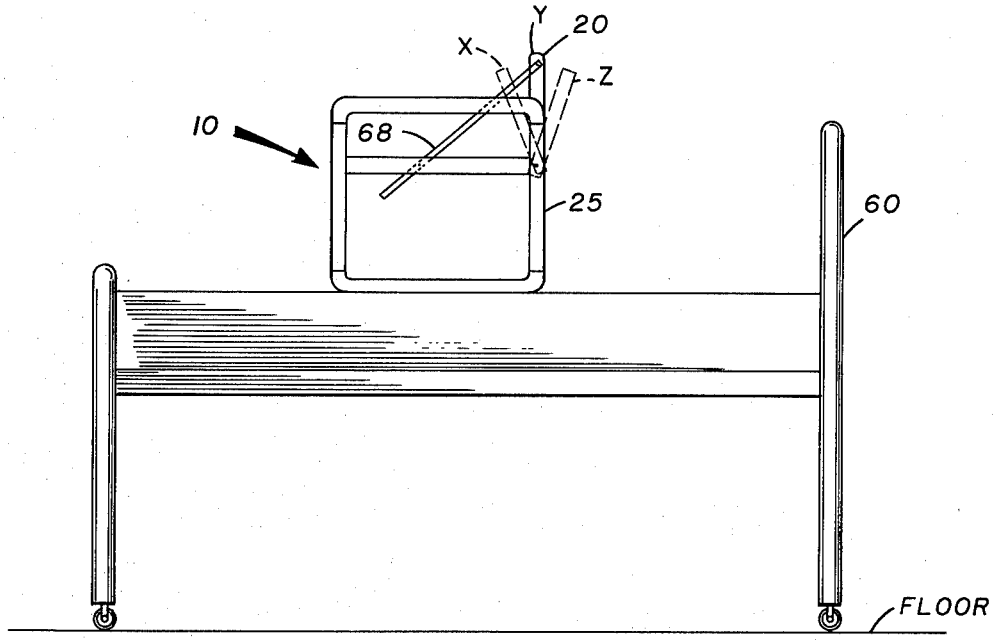
FIG. 1 is a pictorial side view of a hospital type bed showing a device for human body waste elimination mounted thereon.
Figure 2:
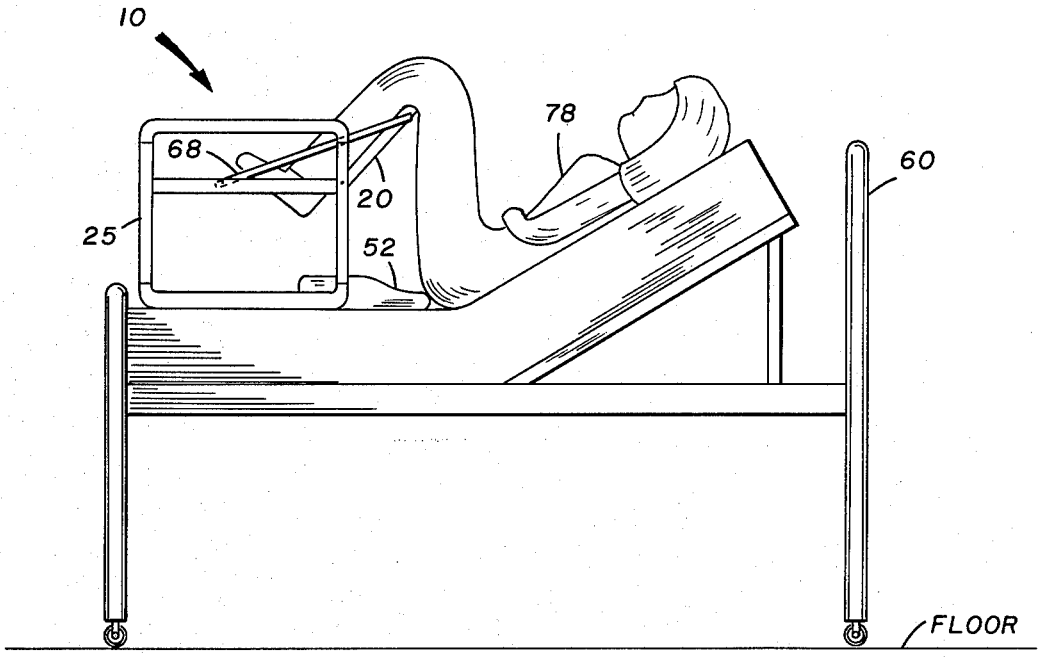
FIG. 2 is a pictorial view of a typical arrangement of a person in a hospital type bed using a device for human body waste elimination.
Figure 3:
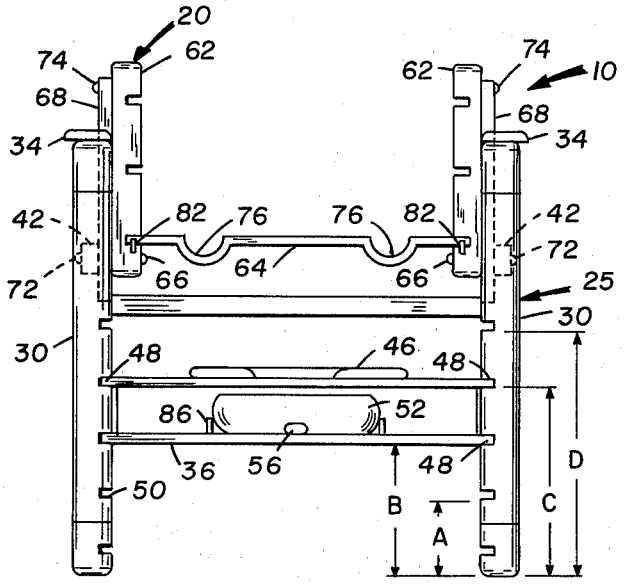
FIG. 3 is a front view of a device for human body waste elimination in a chair type configuration.
Figure 4:
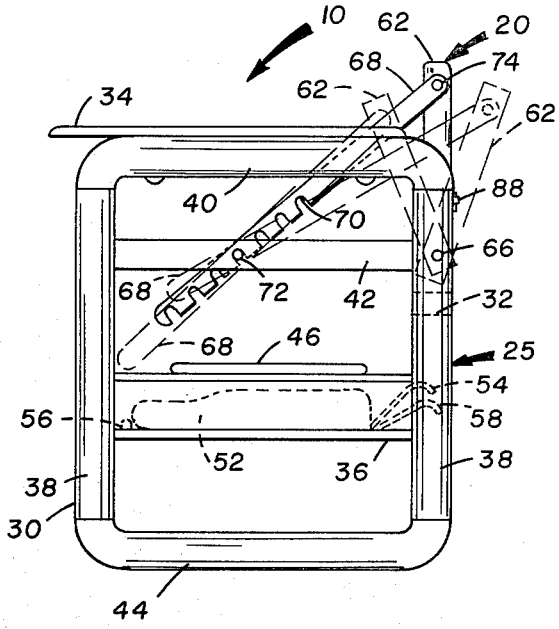
FIG. 4 is a side view of FIG. 3.
Figure 5:
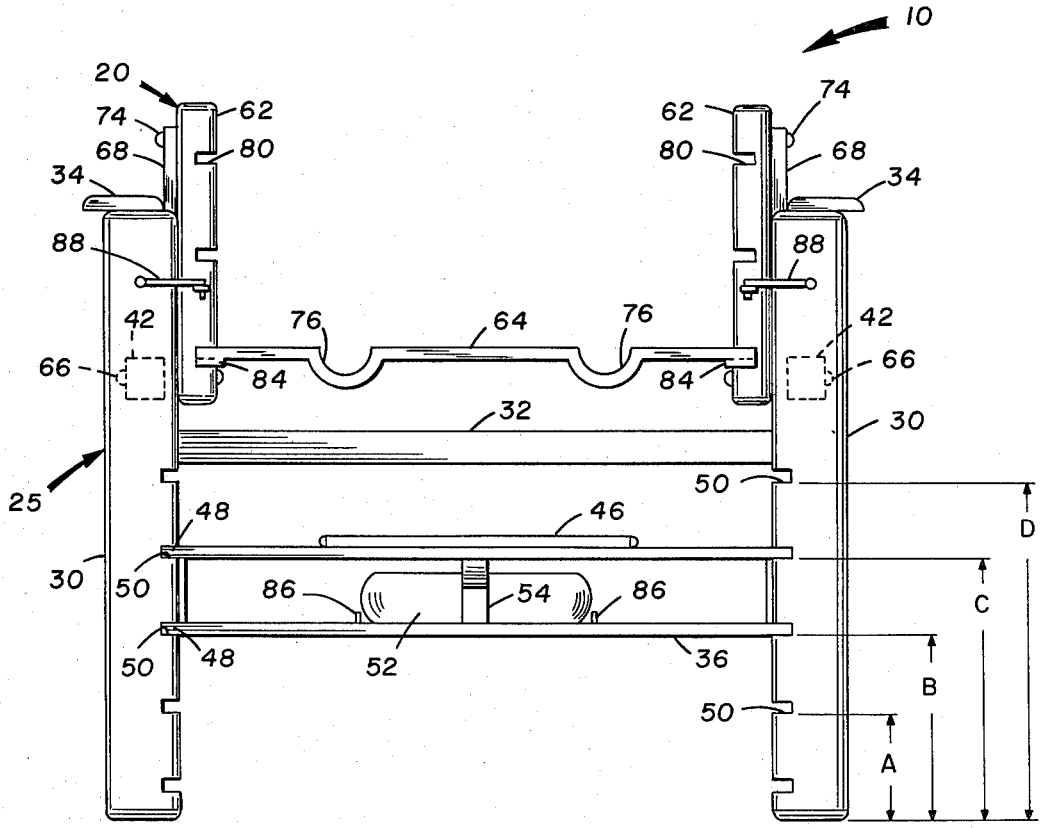
FIG. 5 is a back view of FIG. 3.

Referring to the drawings and particularly to FIGS. 3, 4, and 5, a device for human body waste elimination in a chair type configuration is shown at 10. In FIGS. 1 and 2 a segment of the structure of the device for human body waste elimination 10 is shown in use on a bed at 20. The details of the bed segment structure 20 and the complete structure of the device for human body waste elimination 10 will be described hereinafter.

The complete structure of the chair-like configuration of the device for human body waste elimination 10 will be described first. The device for human body waste elimination 10 consists of a bed segment 20 and a chair frame segment 25.

The chair frame segment 25 consists of a pair of side members 30, a rear strut 32, arm rests 34, one on each side member 30, and a bed pan carrier of holder 36.

The side members 30 each have vertical members 38, a top strut 40 for the arm rest, a center strut 42, and a bottom strut 44. It is to be noted that the side frame members 30 each composed of vertical members 38, top strut 40, center strut 42, and bottom strut 44, when tied together by rear strut 32, forms a rigid monolithic and integral frame structure of chair frame segment 25.

It is to be noted that bottom strut 44 is shown at the extreme bottom of vertical members 38 so as to provide good substantial bed support when placed on a mattress. It is to be understood that a variation using leg-like vertical members 38 with the bottom strut 44 spaced from the lower ends of the vertical members 38, is within the scope and intent of this invention.

It is also to be understood that a variation in the side frame members 30 configuration by relocating or otherwise varying the strut members 40 and 42, and 44 is within the scope and intent of this invention, aside from any secondary function applied to said strut members 40, 42, and 44 hereinbefore or hereinafter.

As noted hereinbefore, the side frame members 30 when tied together by rear strut 32 forms a rigid monolithic and integral frame structure of chair frame segment 25. As shown in the drawings the aforementioned components of the chair frame segment 25 are in the nature of continuous members which may be obtained by welding or brazing techniques well known in the art. However, it is to be understood that any other means of fabrication, such as by screw threaded joints, slip joints riveted or otherwise assembled, continuous forming of some or all elements, or any other means, is within the scope and intent of this invention.

The materials for the chair frame segment 25 are most suited to aluminum, in round or square cross section, to facilitate easy handling and use. It is to be understood, however, that the use of plastics, or plastics covered materials, or other metals or materials is within the scope and intent of this invention.

The arm rests 34 may be metal, wood, plastics or any other suitable material, plain or in combination with other materials, such as a covering of a separate material.

When the device for human body waste elimination 10 is used in the chair configuration for persons who may be in a seated position, the bed segment structure 20 is secured in a vertical position to serve as a back rest for the person in the chair. The bed structure segment 20 is locked in place to serve as the back rest by a movable latch and pin 88 on each side at the back as shown in FIG. 5. It is to be understood that any latch means is within the scope and intent of this invention.

The bed pan carrier or holder 36 has a toilet seat 46 more or less centrally located thereon and positioned so that a user may sit upon the toilet seat 46 with the lower leg portions below the knees clearing the bed pan carrier or holder 36.

As can be seen in FIGS. 3 and 5, when the device for human body waste elimination 10 is used in the chair configuration, the bed pan carrier or holder 36 may be set at a plurality of position heights A, B, C, or D. It is to be understood that more or less position heights than shown and described is within the scope and intent of this invention. The bed pan carrier or holder 36 is positioned at each of the plurality of position heights by pairs of flanges 48, on each side of the bed pan carrier or holder 36 which fit into mating pairs of slots or grooves 50, the slots or grooves 50 being in plurality to match the plurality of position heights A, B, C, and D. The slots or grooves 50 are made in the vertical members 38.

The bed pan carrier or holder 36 has three sides and a bottom, with the rear side and top open, as hereinbefore described a toilet seat 46 is affixed to the top side.

It is to be understood, however, that the use of single slots 50 on each side instead of pairs of slots or grooves 50 or any other slot or groove plurality with corresponding mating flanges 48, is within the scope and intent of this invention.

As can be seen, the positioning of the bed pan carrier or holder 36 automatically determines the height of the toilet seat 46. Thus, by successively lower positions, within the ability of the user, the knees are brought up toward the chest as described hereinbefore for the Marshall Squat Technique, which is an operational method for and part of this invention. Thus, the device for human body waste elimination 10 assists the user in eliminating body waste by moving the lower limgs automatically into a position of the Marshall Squat Technique.

The bed pan 52, is placed in and removed from the bed pan carrier or holder 36 from the rear of the device for human body waste elimination 10. A spring-like means 54 retains the bed pan 52 in place in the bed pan carrier or holder 36. When the bed pan 52 is placed in the carrier or holder 36 and when the bed pan 52 is removed from the carrier or holder 36, the spring-like means 54 is depressed to a position 58 so that the bed pan 52 can be moved in or out of the carrier or holder 36.

Side guide bars, rods, or other means 86 may be installed in bed pan carrier or holder 36 so as to properly center the bedpan 52 under the toilet seat 46 automatically without observation. Such guide means in whatever configuration are within the scope and intent of this invention.

Regarding the plurality of adjustable position heights A, B, C, and D for the toilet seat 46, the position height D is intended to be the height of custom toilet seats, with other variations being set therefrom.

As described, the device for human body waste elimination 10 has been for use in the chair confuguration when placed on the floor for persons who can be in a seated position. The description hereinafter is for use of the device for human waste elimination 10 when used for persons who must remain in bed.

Referring to FIG. 1, the device for human body waste elimination 10 is shown mounted upon a bed 60. A plurality of positions X, Y, and Z for the bed structure segment 20 is shown that would each place the knees of the user at various distances from the chest of the user. This is as described hereinbefore as the Marshall Squat Technique and which is an operational mode or method for the use of the device for human body waste elimination 10 when used by persons who must remain in bed.

It is to be understood that more positions than X, Y, and Z are intended for the bed structure segment 20, but only three have been shown for clarity. The means for achieving more positions in the plurality is describe hereinafter. It is to be understood that any variation, more or less, than that as described herein regarding the plurality of positions for the bed structure 20, is within the scope and intent of this invention.

As noted hereinbefore, the bed structure segment 20 forms the back rest for the chair frame segment 25. The description of the bed structure segment 20 and its operation are described hereinafter.

Bed structure segment 20 consists of a pair of side support members 62, on adjustable transverse leg support 64, a pair of pivot pins 66 movably attaching side support members 62 to vertical members 38, and a pair of position locking bars 68.

When the device for human body waste elimination 10 is to be used for bed fast persons, the device is placed upon the bed just as it is placed upon the floor when used in its configuration as a chair type device. On the bed it rests upon the mattress (or sheeted mattress) in the same upright manner as shown in FIG. 1. Note in FIG. 1 that the bed structure segment 20 may be set at a plurality of positions, three of which are illustrated as X, Y, and Z.

The positions X, Y, and Z are but three of the noted plurality of positions. The positions are set by the locking bars 68, one on each side, which determine the angle at which the side support members 62 will be set. It is through the set angle of side support members 62 that determines the location of the transverse leg support member 64.

The position locking bars 68 each have a plurality of notches or index indentations 70 which are removably placed over holding pins 72 affixed to the center struts 42, one on each strut. The holding pins 72 each have a flange or headlike end which prevents the locking bars 68 from slipping off of the holding pins 72.

The side support members 62 pivot on the pivot pins 66 and the position locking bars 68 pivot on the connecting pins 74 which movably affix the position locking bars 68 to their respective side support members 62. Thus, the plurality of angles at which the transverse leg support 64 may be set, such as illustrated by positions X, Y, and Z, is determined by the specific pair of notches or index indentations 70 selected onto which the position locking bars 68 will be set.

It is to be noted that pivot pins 66 may be in the form of rivets (as illustrated) with sufficient clearance to permit the side support members 62 to move freely, or may be bolts or other suitable connection means, all of which are within the scope and intent to the present invention.

It is also to be understood that it is within the scope and intent of this invention to pivot position locking bars 68 about a connecting pin 74 that is located on the center strut member 42 and is latched, as aforementioned, over holding pins 72 that are located on the side support members 62, a reverse of the system shown in the drawings.

For a bed fast person, the user's legs are placed in leg support crescents 76 in transverse leg support 64. The position of a bed fast person 78 shown in FIG. 2 is thus determined by the preselected position of the bed structure segment 20, such as illustrated in FIG. 1 by positions X, Y, and Z. Thus it can be seen that the advantages of the Marshall Squat Technique can be accomplished for a bed fast person 78 by one of the plurality of variations of the positions that can be selected for the transverse leg support 64 as hereinbefore described. In the various positions the knees are brought up toward the chest to a preselected position and the device for human body waste elimination 10 aids the bed fast person 78 in this requirement.

The leg support crescents 76 may be lined and/or padded with suitable material to increase user comfort. Such lining and/or padding is within the scope and intent of the present invention.

When the bed fast person 78 is in position, the bed pan 52 is placed on the bed 60 in interface with the user 78. The bed pan carrier or holder 36 is not used in this position. It is to be understood, however, that placing a bed pan within the chair frame segment 25 by any means is within the scope and intent of this invention.

A plurality of slot-like openings 80 in side support members 62 provide for adjustments of the level of the transverse leg support 64 to fit a plurality of persons as to their personal height and the length of their legs. Movable retaining clips 82, affixed to the ends of the transverse leg support 64 secure the transverse leg support 64 in the slot-like openings 80.

It is to be understood that the movable retaining clips 82 may be placed on either side of the side support members 62, preferably on the "down side" when the transverse leg support 64 is in place, as a safety precaution. The side opposite to the movable retaining clips 82 is secured by a flange-like lip 84. It is also to be understood that movable retaining clips 82 may be used on each side of each of the ends of transverse leg support 64 instead of using a flange-like lip 84 on one side. Also, that the movable retaining clips 82 may be affixed to the side support members 62 instead of the transverse leg support 64.

Special adhesive privy drapes or screens, or regular bed linen, may be attached to or draped over said device for human body waste elimination 10 to provide privacy when used for a bed fast person. When used for a seated person privacy may be accomplished by hospital type screens or curtains. Such accessory accommodations are understood to be within the scope and intent of the invention.

Application of the Marshall Squat Technique and the degree to which the toilet seat 46 height or transverse leg support 64 angle is set will be as established by competent medical authority in using the technique or the device for human waste elimination 10.

As can be readily understood from the foregoing description of the invention, the present structure can be configured in different modes to provide the ability to assist bed fast and chair fast persons in human body waste elimination.

Accordingly, modification and variations to which the invention is susceptible may be practiced without departing from the scope and intent of the appended claims.

What is claimed is:

1. A device for human body waste elimination, during incapacitation, comprising:

a chair-like structure;

a back rest structure, said back rest structure consisting of a pair of support members, said support members being movably affixed to said chair-like structure, said support members having a plurality of slots therein;

a leg support member for a user, said leg support member having a pair of crescent-like depressed areas therein, each said depressed area providing a holding means for one of the legs of a user, said leg support member being removably and adjustably affixed to said pair of support members in a matching pair of said plurality of slots in said pair of support members;

a pair of pivot means, said pivot means movably affixing said pair of support members to said chair-like structure;

a pair of locking means, said locking means being affixed to said pair of support members and removably affixed to said chair-like structure, said locking means being capable of locking said pair of support member means with said leg support member in a plurality of adjustable positions;

a pair of latching means, said latching means being movably affixed to said chair-like structure to latch said back rest structure into a back-rest position for said chair-like structure;

a bed pan holding means, chair-like structure having a plurality of slots therein, said plurality of slots providing a means for said bed pan holding means being adjustably and removably located within said chair-like structure;

a toilet seat, said toilet seat being affixed to said bed pan holding means; and a bed pan, said bed pan being used in association with said chair-like structure.

2. The device for human body waste elimination as recited in claim 1, wherein said bed pan holding means consists of:

a bottom member;

three side members, said three sides affixed to three sides of said bottom member;

two pairs of flange members, a first pair of said flange members being affixed to a first of said side members, and a second pair of said flange members being affixed to a second of said side members, said first and second side members being affixed opposite each other to said bottom member;

and a bed pan securing means, said securing means being spring like and affixed to inside of said bed pan holding means, said securing means extending to side of said bottom member without a side affixed thereto.

3. The device for human body waste elimination as recited in claim 1, wherein said locking means has a plurality of index notches on one edge thereof, said plurality of index notches providing means for said plurality of adjustable positions.

4. The device for human body waste elimination as recited in claim 2, and additionally, means for centering said bed pan under said toilet seat, said means for centering said bed pan being located inside said bed pan holding means and affixed to the bottom thereof.

* * * * *